US007677992B2

(12) United States Patent
Moos

(10) Patent No.: US 7,677,992 B2
(45) Date of Patent: Mar. 16, 2010

(54) APPARATUS AND METHOD FOR TRAINING A BASEBALL BATTER TO SWING A BASEBALL BAT LEVEL

(76) Inventor: Michael R. Moos, 13621 Thistlewood Dr. E., Carmel, IN (US) 46032

( * ) Notice: Subject to any disclaimer, the term of this patent is extended or adjusted under 35 U.S.C. 154(b) by 0 days.

(21) Appl. No.: 12/474,313

(22) Filed: May 29, 2009

(65) Prior Publication Data

US 2009/0239686 A1 Sep. 24, 2009

Related U.S. Application Data

(63) Continuation of application No. 11/704,758, filed on Feb. 9, 2007, now abandoned.

(51) Int. Cl.
*A63B 69/00* (2006.01)

(52) U.S. Cl. ..... 473/453; 473/422; 473/457

(58) Field of Classification Search ..... 473/453, 473/422, 451, 450, 457, 437, 428, 426; 482/7, 482/40, 92, 94, 118, 129
See application file for complete search history.

(56) References Cited

U.S. PATENT DOCUMENTS 1,708,796 A * 4/1929 Lawrence ..... 473/429
2,134,451 A * 10/1938 Mogren ..... 482/94
2,655,378 A * 10/1953 Sheffer ..... 473/229
2,772,882 A * 12/1956 Anson ..... 473/429
3,086,775 A * 4/1963 Albert ..... 473/428
3,469,840 A * 9/1969 Kruzel ..... 473/428
3,618,942 A * 11/1971 Bates et al. ..... 482/129
3,830,494 A * 8/1974 Biskup ..... 473/429
3,924,855 A * 12/1975 Pretorius ..... 473/575
4,243,219 A * 1/1981 Price ..... 482/103
4,664,375 A * 5/1987 Tetreault ..... 473/429
4,749,189 A * 6/1988 Frank ..... 482/129
5,082,262 A * 1/1992 Sanchez ..... 473/458
5,269,512 A * 12/1993 Crowson et al. ..... 473/457
5,423,730 A * 6/1995 Hirsch ..... 482/92
5,823,895 A * 10/1998 Rasic ..... 473/430
5,842,938 A * 12/1998 Garber ..... 473/430
6,000,944 A * 12/1999 Schiefer ..... 434/251
6,245,002 B1 * 6/2001 Beliakov ..... 482/148
6,413,196 B1 * 7/2002 Crowson ..... 482/118
6,537,184 B2 * 3/2003 Kim ..... 482/122
6,592,474 B1 * 7/2003 Halsworth ..... 473/453
6,669,152 B2 * 12/2003 Hernandez ..... 248/165
2009/0215555 A1 * 8/2009 Seiter et al. ..... 473/422

* cited by examiner

*Primary Examiner*—Mitra Aryanpour
(74) *Attorney, Agent, or Firm*—Bruce J. Bowman

(57) ABSTRACT

A baseball bat swing trainer attaches to a baseball bat and is configured to train a batter to maintain a level swing. The baseball bat swing trainer is attachable to a horizontal structure that is over the head of the batter and to a baseball bat. The baseball bat swing trainer includes a single-unit line controller, a line, and a baseball bat coupling connected to the line. The line controller is configured to vary and fix a working length of line defined as extending from the line controller to the baseball bat. The line may be varied in length, a working length, in order to accommodate different size batters. The line controller is configured to keep and release excess line. The coupling is secured onto the baseball bat at a location taken from a handle of the baseball bat that is approximately 50% of an overall length of the baseball bat.

12 Claims, 6 Drawing Sheets

APPARATUS AND METHOD FOR TRAINING A BASEBALL BATTER TO SWING A BASEBALL BAT LEVEL

RELATED APPLICATIONS

This patent application is a continuation of U.S. patent application Ser. No. 11/704,758 filed Feb. 9, 2007, now abandoned entitled "Apparatus and Method for Training a Baseball Batter to Swing a Baseball Bat Level" and hereby claims the benefit of and/or priority thereto.

BACKGROUND OF THE INVENTION

1. Field of the Invention

The present invention relates generally to athletic training devices and, more particularly, relates to swing training devices for baseball batters.

2. Background Information

The sport of baseball requires the development of various skills. One of these skills is the ability to optimally swing a baseball bat. While there are many aspects to producing an optimum swing, one aspect is the ability to swing the baseball bat level. A level swing provides optimum contact with the ball and thus produces the best transfer of momentum from the baseball bat to the ball. A level swing can therefore be attributed to better hitting.

As with other repetitive sports, it is desirable to develop what is known as muscle memory for the particular manner of sport movement. Developing muscle memory for a particular sport movement is essentially repeating the particular sport movement until the muscles memorize the particular movement. Thus, repeatedly practicing a level swing allows the utilized muscles to memorize what a level swing is like so that proper execution of a level swing becomes automatic.

In view of this, various devices have been developed that purport to aid in training a batter to swing a baseball bat level. Some of these swing training devices include various manners of hanging a ball from a rope that is attached to a horizontal member. Other swing training devices include a ball that is attached to a rigid member. Still other swing training devices use a combination of the above-mentioned methods such as hanging a rope attached to a ball with a portion of the rope passing through a tube positioned above the ball.

These devices, however, have various drawbacks. For instance, they are typically either overly complex, fail to adequately allow duplication of a level swing, are not well suited to allow the user to easily learn a level swing, or are difficult to adjust to different sized batters. What is therefore needed, for instance, is a baseball bat swing training device that efficiently teaches a player to swing a baseball bat level and is uncomplicated in structure, economic to produce and easily adjustable for different size batters. What is also needed, for instance, is a method for training a baseball batter to swing a baseball bat level.

It is an object of the present invention to provide a baseball bat swing training device that satisfies one or more of the mentioned needs. It is furthermore an object of the present invention to provide a baseball bat swing training method that satisfies one or more of the mentioned needs.

SUMMARY OF THE INVENTION

The present invention is an apparatus and method for training a baseball batter to swing a baseball bat level.

A baseball bat swing training device in accordance with the present principles trains a baseball batter to maintain a level swing of a baseball bat during batting by constraining the baseball bat during a portion of the batter's swing such that the baseball bat cannot be swung by the batter at less than a level swing. The baseball bat is suspended from an overhead position via attachment to a line. The length of line between the baseball bat and a line controller retaining the line is alterable to provide a selectable working length of line that allows the batter to freely swing the baseball bat but limit the downward travel thereof past the working length wherein the baseball bat cannot be swung by the batter at no less than a level swing. Setting the working length of line at an appropriate setting allows the present baseball bat swing training device to provide adjustment specifically for the particular baseball batter.

In one form of the invention, the baseball bat swing training device includes a frame having an overhead portion that is adjustable in height in order to accommodate different height batters. A baseball bat suspension and control device is connectable to the overhead portion of the frame and is adapted to regulate an amount of line that extends from the control device to an end of the line (the working length). The free end of the line is then attached to the baseball bat. The amount or length of the line extending from the control device regulates the distance at which the bat swing is level relative to the ground. This allows accommodation for different size batters.

In one form, the adjustable frame includes right and left adjustable leg structures that support an overhead cross bar. The baseball bat suspension and control device is attached to the cross bar. The baseball bat suspension and control device stores and releases excess line for selectively adjusting the working length of the line.

In another form, the adjustable frame includes an upright that supports a vertical beam at its end. The baseball bat suspension and control device is attached to the vertical beam. The baseball bat suspension and control device stores and releases excess line for selectively adjusting the working length of the line.

In one form, the baseball bat swing trainer includes an overhead mountable baseball bat suspension and line controller, a line and a baseball bat attachment device disposed at an end of the line distal the baseball bat suspension and line controller. The baseball bat suspension and line controller is connectable to an overhead area and is adapted to regulate an amount of line that extends from a line controller portion of the baseball bat suspension and line controller to the baseball bat attachment which is connected to the baseball bat. The amount or length of the line extending from the line controller regulates the distance at which the bat swing is level relative to the ground (the working length). This working length adjustment allows accommodation for different size batters.

In one form, the line is attached to the baseball bat by a collar. The collar is preferably attached to the baseball bat at a point that is approximately forty percent of the length of the baseball bat from the end of the handle of the baseball bat.

In one form, the baseball bat suspension and line control device includes a line clamp that is attached to the frame. The line clamp is adapted to clamp onto and fix the line such that a predetermined length of line is set between the clamp and the baseball bat.

In one form, the baseball bat suspension and line control device includes or further includes a spool attachable to a frame. The spool is configured to receive excess line from the clamp. The spool is also configured to let out line as necessary.

In another form of the invention, the baseball bat swing trainer is attachable to an overhead structure and a baseball bat. The baseball bat swing trainer includes a baseball bat suspension and line controller or regulator including a line spool, a line retention device, a line, and a baseball bat attachment device. The line retention device is adapted to be attached to an overhead structure and is configured to clamp onto the line in order to fix a length of line extending from the line retention device to the baseball bat attachment device. The line spool is adapted to be attached to the overhead structure and is configured to keep and release excess line from and to the line retention device. The baseball attachment device is attached to an end of the line and is configured to be secured on the baseball bat. The baseball bat suspension and line controller, in this form, is a baseball bat swing trainer or training device. In this manner, the baseball bat swing trainer may be mounted to various structures. The baseball attachment device is preferably attached to the baseball bat at a point that is approximately forty percent of the length of the baseball bat from the end of the handle of the baseball bat.

BRIEF DESCRIPTION OF THE DRAWINGS

The above mentioned and other features and objects of this invention, and the manner of attaining them, will become more apparent and the invention itself will be better understood by reference to the following description of embodiments of the invention taken in conjunction with the accompanying drawings, wherein.

Like reference numerals indicate the same or similar parts throughout the several figures.

A description of the features, functions and/or configuration of the components depicted in the various figures will now be presented. It should be appreciated that not all of the features of the components of the figures are necessarily described. Some of these non discussed features as well as discussed features are inherent from the figures. Other non discussed features may be inherent in component geometry and/or configuration.

DETAILED DESCRIPTION OF THE PREFERRED EMBODIMENTS

Figure 1:
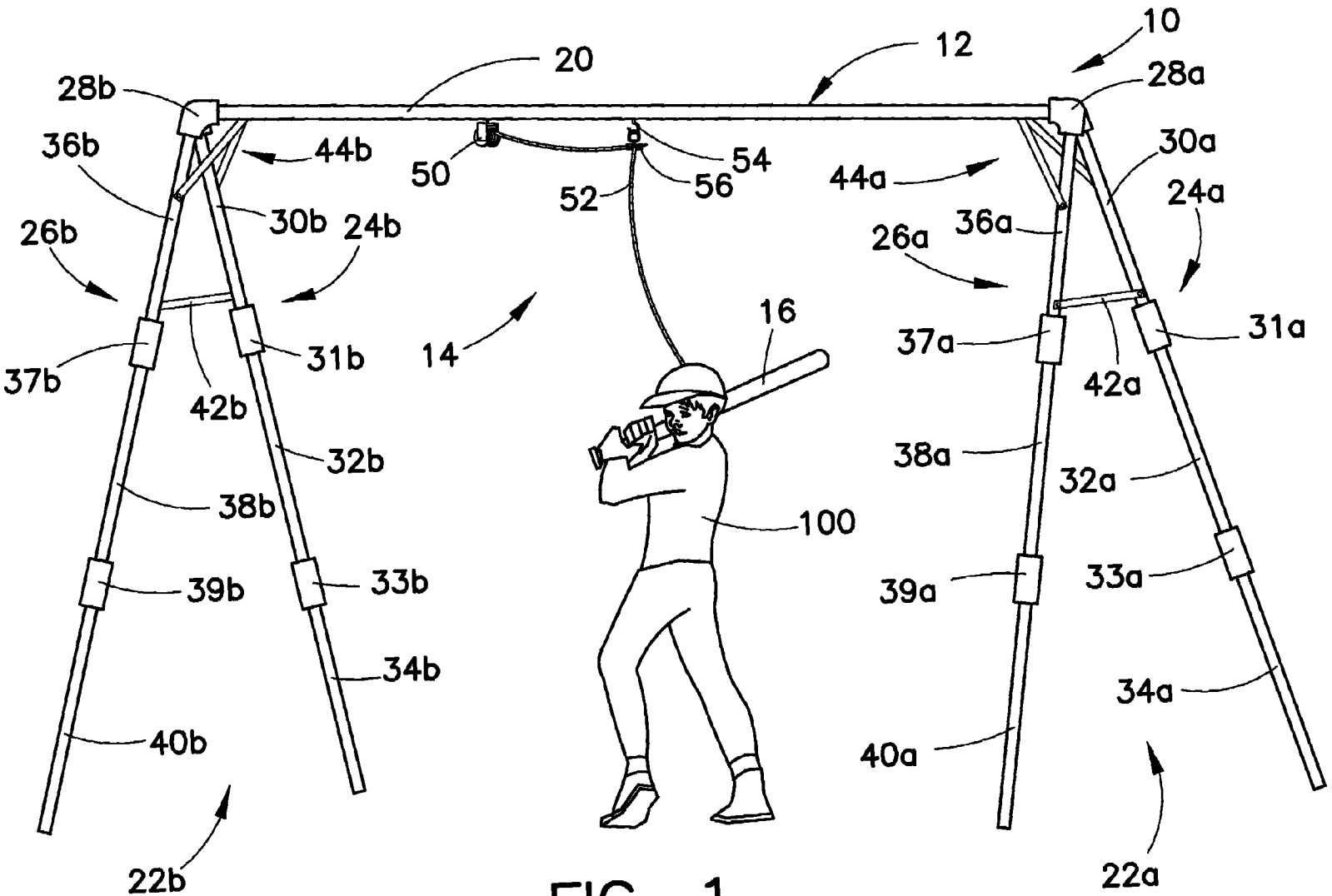
FIG. 1 is a perspective view of an embodiment of a baseball bat swing training device fashioned in accordance with the present principles, a user of which is shown in a pre-swing position.

Referring to FIG. 1, there is depicted one embodiment of a baseball bat swing training device or swing trainer generally designated 10. The baseball bat swing training device 10 is characterized by a frame 12 and a baseball bat suspension and control device 14. The frame 12 is adjustable in height as described herein in order to accommodate different size users. The baseball bat suspension and control device 14 permits adjustment in order to appropriately position a baseball bat 16 as described herein in order to accommodate different size users. Such adjustment is sets the working height or length for the baseball bat 16 as described herein.

The frame 12 consists of a cross bar 20 and right and left adjustable leg structures 22*a* and 22*b* that support the cross bar 20. The frame 12 and right and left adjustable leg structures 22*a*, 22*b* are made from a suitable metal such as aluminum, steel or the like, a plastic, composite, combination thereof or other suitable material.

The right adjustable leg structure 22*a* is formed by a first adjustable leg 24*a* and a second adjustable leg 26*a*. One end of the first adjustable leg 24*a* and one end of the second adjustable leg 26*a* are retained in a right upper coupling 28*a* such that the first and second adjustable legs 24*a*, 26*a* form an inverted V. A brace 42*a* connects to and extends between the first and second adjustable legs 24*a*, 26*a* to maintain the spread or distance between the first and second adjustable legs 24*a*, 26*a*.

The first adjustable leg 24*a* is formed of multiple leg sections, segments or sections 30*a*, 32*a* and 34*a*. The leg section 30*a* is connected at one end to the right upper coupling 28*a* and at an end distal thereof to the leg section 32*a*. The leg section 32*a* is received in the leg section 30*a* in a telescopic manner such as is know in the art. A leg section adjustment coupling 31*a* is situated at the junction of the leg section 30*a* and the leg section 32*a* and is adapted to allow the leg section 32*a* to axially slide into the leg section 30*a* and then temporarily fix the axial position of the leg section 32*a* relative to the leg section 30*a*. This may be accomplished by having axial slits in the end of the leg section 30*a* that allow radial constriction of the end of the leg section 30*a* around the end of the leg section 32*a* that extends therein. The leg section adjustment coupling 31*a* would have internal threads that allow the leg section adjustment coupling 31*a* to be threadedly received onto the external threads of the leg section 30*a*. Rotation of the leg section adjustment coupling 31*a* in one direction constricts the end of the leg section 30*a* around the end of the leg section 32*a* while rotation in the opposite direction loosens the end of the leg section 30*a* from around the end of the leg section 32*a*. In this manner, the length of the leg section 32*a* relative to the leg section 30*a* is adjustable.

The leg section 34*a* is received in the leg section 32*a* in a telescopic manner such as is know in the art. A leg section adjustment coupling 33*a* is situated at the junction of the leg section 32*a* and the leg section 34*a* and is adapted to allow the leg section 34*a* to axially slide into the leg section 32*a* and then temporarily fix the axial position of the leg section 34*a* relative to the leg section 32*a*. This may be accomplished by having axial slits in the end of the leg section 32*a* that allow radial constriction of the end of the leg section 32*a* around the end of the leg section 34*a* that extends therein. The leg section adjustment coupling 33*a* would have internal threads that allow the leg section adjustment coupling 33*a* to be threadedly received onto the external threads of the leg section 32*a*. Rotation of the leg section adjustment coupling 33*a* in one direction constricts the end of the leg section 32*a* around the end of the leg section 34*a* while rotation in the opposite direction loosens the end of the leg section 32*a* from around the end of the leg section 34*a*. In this manner, the length of the leg section 34*a* relative to the leg section 32*a* is adjustable.

The second adjustable leg 26*a* is formed of multiple leg sections, segments or sections 36*a*, 38*a* and 40*a*. The leg section 36*a* is connected at one end to the right upper coupling 28*a* and at an end distal thereof to the leg section 38*a*. The leg section 38*a* is received in the leg section 36*a* in a telescopic manner such as is know in the art. A leg section adjustment coupling 37*a* is situated at the junction of the leg section 36*a* and the leg section 38*a* and is adapted to allow the leg section 38*a* to axially slide into the leg section 36*a* and then temporarily fix the axial position of the leg section 38*a* relative to the leg section 36*a*. This may be accomplished by having axial slits in the end of the leg section 36*a* that allow radial constriction of the end of the leg section 36*a* around the end of the leg section 38*a* that extends therein. The leg section adjustment coupling 37*a* would have internal threads that allow the leg section adjustment coupling 37*a* to be threadedly received onto the external threads of the leg section 36*a*. Rotation of the leg section adjustment coupling 37*a* in one direction constricts the end of the leg section 36*a* around the end of the leg section 38*a* while rotation in the opposite direction loosens the end of the leg section 36*a* from around the end of the leg section 38*a*. In this manner, the length of the leg section 38*a* relative to the leg section 36*a* is adjustable.

The leg section 40*a* is received in the leg section 38*a* in a telescopic manner such as is know in the art. A leg section adjustment coupling 39*a* is situated at the junction of the leg section 38*a* and the leg section 40*a* and is adapted to allow the leg section 40*a* to axially slide into the leg section 38*a* and then temporarily fix the axial position of the leg section 40*a* relative to the leg section 38*a*. This may be accomplished by having axial slits in the end of the leg section 38*a* that allow radial constriction of the end of the leg section 38*a* around the end of the leg section 40*a* that extends therein. The leg section adjustment coupling 39*a* would have internal threads that allow the leg section adjustment coupling 39*a* to be threadedly received onto the external threads of the leg section 38*a*. Rotation of the leg section adjustment coupling 39*a* in one direction constricts the end of the leg section 38*a* around the end of the leg section 40*a* while rotation in the opposite direction loosens the end of the leg section 38*a* from around the end of the leg section 40*a*. In this manner, the length of the leg section 40*a* relative to the leg section 38*a* is adjustable.

Bracing 44*a* is provided from the first and second adjustable legs 24*a*, 26*a* to the cross bar 20. The bracing 44*a* provides stability between the right adjustable leg structure 22*a* and the cross bar 20. The right adjustable leg structure 22*a* thus provides height adjustment of the right end of the cross bar 20 relative to the ground or other surface upon which the baseball bat swing trainer 10 is placed.

The left adjustable leg structure 22*b* is formed by a first adjustable leg 24*b* and a second adjustable leg 26*b*. One end of the first adjustable leg 24*b* and one end of the second adjustable leg 26*b* are retained in a left upper coupling 28*b* such that the first and second adjustable legs 24*b*, 26*b* form an inverted V. A brace 42*b* connects to and extends between the first and second adjustable legs 24*b*, 26*b* to maintain the spread or distance between the first and second adjustable legs 24*b*, 26*b*.

The first adjustable leg 24*b* is formed of multiple leg sections, segments or sections 30*a*, 32*a* and 34*a*. The leg section 30*b* is connected at one end to the left upper coupling 28*b* and at an end distal thereof to the leg section 32*b*. The leg section 32*b* is received in the leg section 30*b* in a telescopic manner such as is know in the art. A leg section adjustment coupling 31*b* is situated at the junction of the leg section 30*b* and the leg section 32*b* and is adapted to allow the leg section 32*b* to axially slide into the leg section 30*b* and then temporarily fix the axial position of the leg section 32*b* relative to the leg section 30*b*. This may be accomplished by having axial slits in the end of the leg section 30*b* that allow radial constriction of the end of the leg section 30*b* around the end of the leg section 32*b* that extends therein. The leg section adjustment coupling 31 b would have internal threads that allow the leg section adjustment coupling 31*b* to be threadedly received onto the external threads of the leg section 30*b*. Rotation of the leg section adjustment coupling 31*b* in one direction constricts the end of the leg section 30*b* around the end of the leg section 32*b* while rotation in the opposite direction loosens the end of the leg section 30*b* from around the end of the leg section 32*b*. In this manner, the length of the leg section 32*b* relative to the leg section 30*b* is adjustable.

The leg section 34*b* is received in the leg section 32*b* in a telescopic manner such as is know in the art. A leg section adjustment coupling 33*b* is situated at the junction of the leg section 32*b* and the leg section 34*b* and is adapted to allow the leg section 34*b* to axially slide into the leg section 32*b* and then temporarily fix the axial position of the leg section 34*b* relative to the leg section 32*b*. This may be accomplished by having axial slits in the end of the leg section 32*b* that allow radial constriction of the end of the leg section 32*b* around the end of the leg section 34*b* that extends therein. The leg section adjustment coupling 33*b* would have internal threads that allow the leg section adjustment coupling 33*b* to be threadedly received onto the external threads of the leg section 32*b*. Rotation of the leg section adjustment coupling 33*b* in one direction constricts the end of the leg section 32*b* around the end of the leg section 34*b* while rotation in the opposite direction loosens the end of the leg section 32*b* from around the end of the leg section 34*b*. In this manner, the length of the leg section 34*b* relative to the leg section 32*b* is adjustable.

The second adjustable leg 26*b* is formed of multiple leg sections, segments or sections 36*b*, 38*b* and 40*b*. The leg section 36*b* is connected at one end to the left upper coupling 28*b* and at an end distal thereof to the leg section 38*b*. The leg section 38*b* is received in the leg section 36*b* in a telescopic manner such as is know in the art. A leg section adjustment coupling 37*b* is situated at the junction of the leg section 36*b* and the leg section 38*b* and is adapted to allow the leg section 38*b* to axially slide into the leg section 36*b* and then temporarily fix the axial position of the leg section 38*b* relative to the leg section 36*b*. This may be accomplished by having axial slits in the end of the leg section 36*b* that allow radial constriction of the end of the leg section 36*b* around the end of the leg section 38*b* that extends therein. The leg section adjustment coupling 37*b* would have internal threads that allow the leg section adjustment coupling 37*b* to be threadedly received onto the external threads of the leg section 36*b*. Rotation of the leg section adjustment coupling 37*b* in one direction constricts the end of the leg section 36*b* around the end of the leg section 38*b* while rotation in the opposite direction loosens the end of the leg section 36*b* from around the end of the leg section 38*b*. In this manner, the length of the leg section 38*b* relative to the leg section 36*b* is adjustable.

The leg section 40*b* is received in the leg section 38*b* in a telescopic manner such as is know in the art. A leg section adjustment coupling 39*b* is situated at the junction of the leg section 38*b* and the leg section 40*b* and is adapted to allow the leg section 40*b* to axially slide into the leg section 38*b* and then temporarily fix the axial position of the leg section 40*b* relative to the leg section 38*b*. This may be accomplished by having axial slits in the end of the leg section 38*b* that allow radial constriction of the end of the leg section 38*b* around the end of the leg section 40*b* that extends therein. The leg section adjustment coupling 39*b* would have internal threads that allow the leg section adjustment coupling 39*b* to be threadedly received onto the external threads of the leg section 38*b*. Rotation of the leg section adjustment coupling 39*b* in one direction constricts the end of the leg section 38*b* around the end of the leg section 40*b* while rotation in the opposite direction loosens the end of the leg section 38*b* from around the end of the leg section 40*b*. In this manner, the length of the leg section 40*b* relative to the leg section 38*b* is adjustable.

Bracing 44*b* is provided from the first and second adjustable legs 24*b*, 26*b* to the cross bar 20. The bracing 44*b* provides stability between the left adjustable leg structure 22*b* and the cross bar 20. The left adjustable leg structure 22*b* thus provides height adjustment of the left end of the cross bar 20 relative to the ground or other surface upon which the baseball bat swing trainer 10 is placed.

It should be appreciated that other manners of providing length adjustment of the leg sections of the adjustable legs relative to one another may be used. One such manner is the use of a plurality of holes in the end of a leg section and a biased button situated in the end of an adjoining leg section. Pushing in the biased button would allow the leg section to axially slide within and relative to the adjoining leg section. The biasing of the button causes the button to stay within a particular hole. This provides discrete length adjustment rather than infinite length adjustment as described above. It should also be appreciated that the number of leg sections may vary. Also, while the first and second leg structures 22*a* and 22*b* are identical, they need not be.

The baseball bat suspension and control device 14 is connected to the frame 12 and suspends the baseball bat 16 from the cross bar 20. Particularly, the baseball bat suspension and control device 14 is configured to retain the baseball bat 16 and retain the baseball bat 16 at a working height in order to allow the user 100 to freely swing the baseball bat 16 but not allow the baseball bat 16 to go below a predetermined height relative to the ground. This predetermined height is the height from the ground that permits a level swing of the baseball bat 16 by the particular user 100. The baseball bat suspension and control device 14 does not allow the user 100 to swing the baseball bat 16 lower than level with the ground.

The baseball bat suspension and control device 14 includes a line 52 that attaches at one end thereof to the baseball bat 16 and at another end to a reel 50 that is attached to the cross bar 20. The line 52 may constitute a line, cord, rope, cable, lead, string, lash, tether or the like and be made of any suitable material such as, but not being exclusive of, natural and/or man-made fiber(s), plastic coated cable, a plastic such as fishing line, polypropylene or otherwise, a metal, a composite or the like. A length of the line 52 is wound upon the reel 50. The cord 52 extends through a clamping device 54 that is also attached to the cross bar 20. The clamping device 54 is preferably, but not necessarily, attached to the cross bar 20 at a midpoint thereof while the reel 50 is attached to the cross bar a distance from the attachment point of the clamping device 54.

Figure 4:
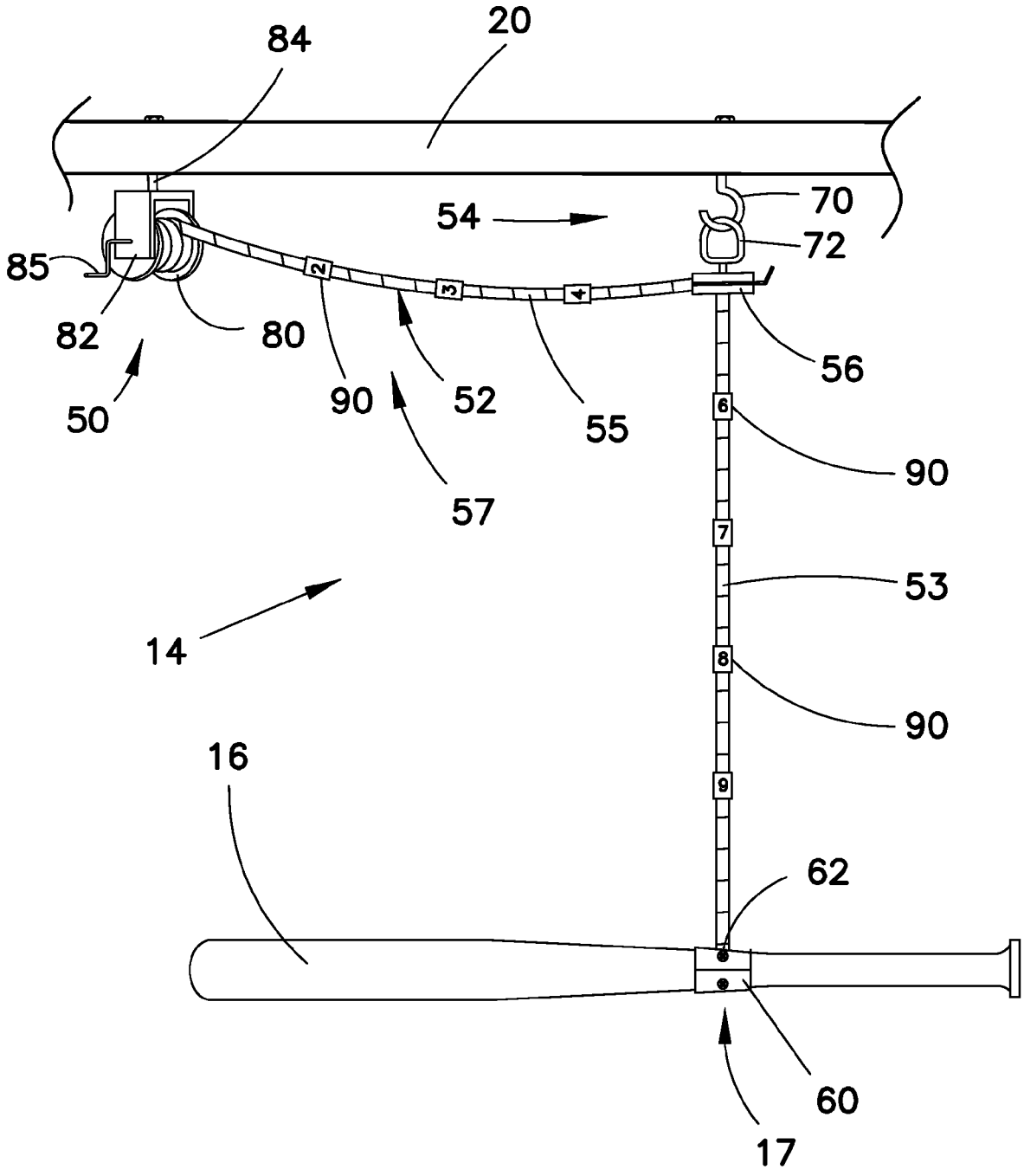
FIG. 4 is an enlarged perspective view of a line controller portion of the present baseball bat swing training device of FIG. 1 or as a stand-alone baseball bat swing training device particularly illustrating the manner of attachment of the baseball bat to a line controller of or constituting the baseball bat swing training device and its length adjustment thereof.

Referring to FIG. 4, an embodiment of the baseball bat suspension and control device 14 is shown. The baseball bat suspension and control device 14 is, by itself, a baseball bat swing training device fashioned in accordance with the present principles. The baseball bat swing training device 14 includes a line controller or regulator constituted by reel 50 and clamping device 54.

The reel 50 includes a spool 80 that is rotatably retained by a bracket 82. The bracket 82 is connected via a bolt or the like 84 to the cross bar 20. The cord 52 is wound upon the rotatable spool 80 such that a length of cord 55 extends from the spool 80 to the clamping device 54. The cord 52 may be wound onto the spool via a crank or handle 85 and unwound via pulling on the cord 52. The clamping device 54 includes a clamp 56 that is attached to the cross bar 20 and configured to allow the cord 52 to slide therethrough when unclamped but fix a length 53 (the working length 53) when clamped. The clamp is connected to the cross bar 20 via a bolt hook 70 that is attached through the cross bar 20 and an eye 72 that is connected to the clamp 56. Of course, the cord clamp 56 may be attached to the cross bar 20 in other manners.

The clamping device 54 is configured to clamp and unclamp the cord 52 such that when clamped, the cord 52 sets or fixes the working or batting length 53 of cord between the clamping device 54 and the baseball bat 16 and when unclamped allows the winding or unwinding of the cord 52 from the reel 50 in order to adjust the working length 53 between the clamping device 54 and the baseball bat 16. The working length 53 is selected such that the batter or user 100 may never swing below a level swing. As seen in FIG. 4, the cord 52 may include a plurality of marks, markers, tags, labels, demarcations or the like 90 that are positioned along the cord 52. These marks allow the visual setting and remembering of various working or batting lengths. In FIG. 4, the working length is set at "5." These marks may or may not correspond to lengths or distances in known measurements.

Figure 2:
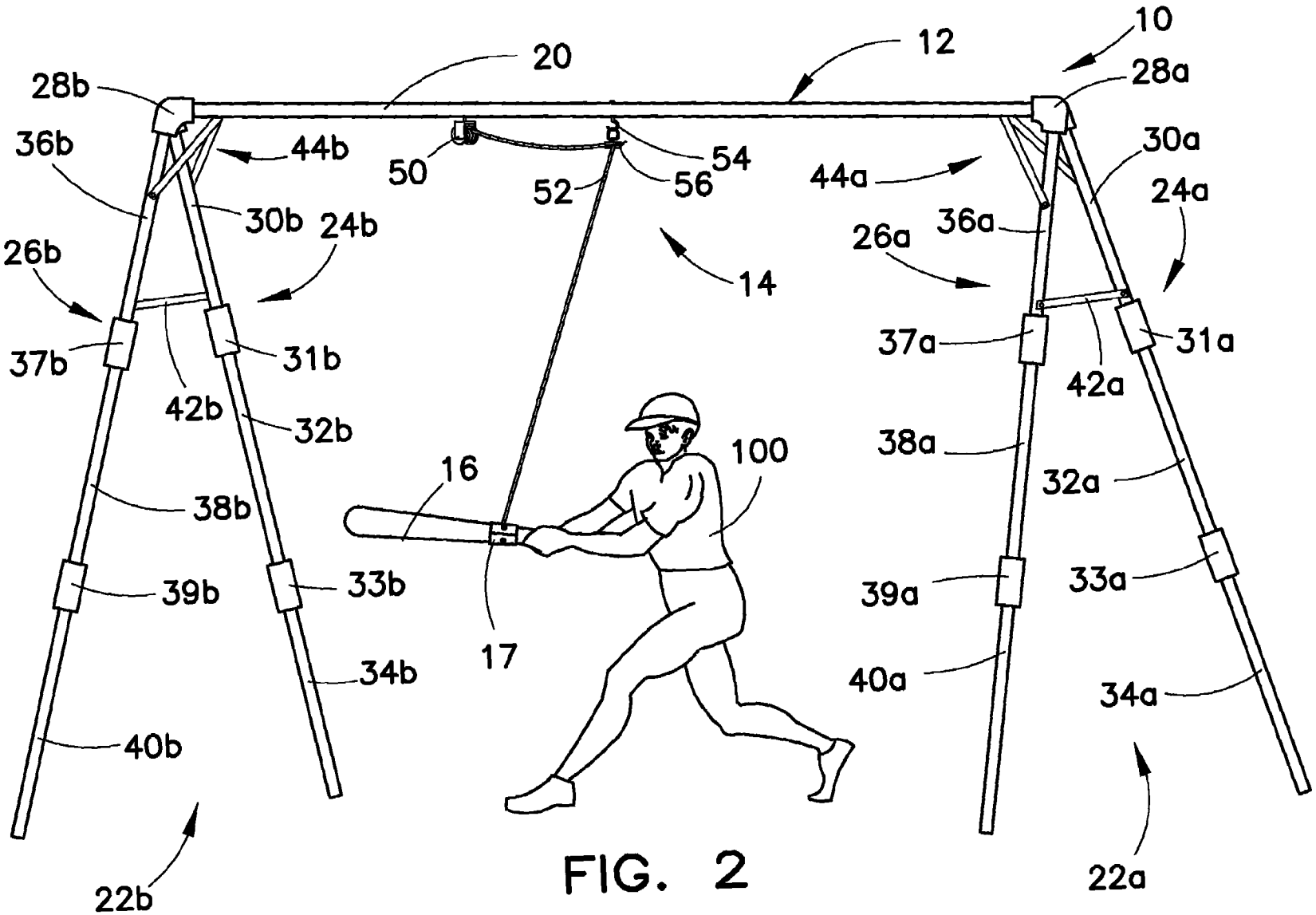
FIG. 2 is a perspective view of the baseball bat swing training device of FIG. 1, the user of which is shown in a mid-swing position.
Figure 3:
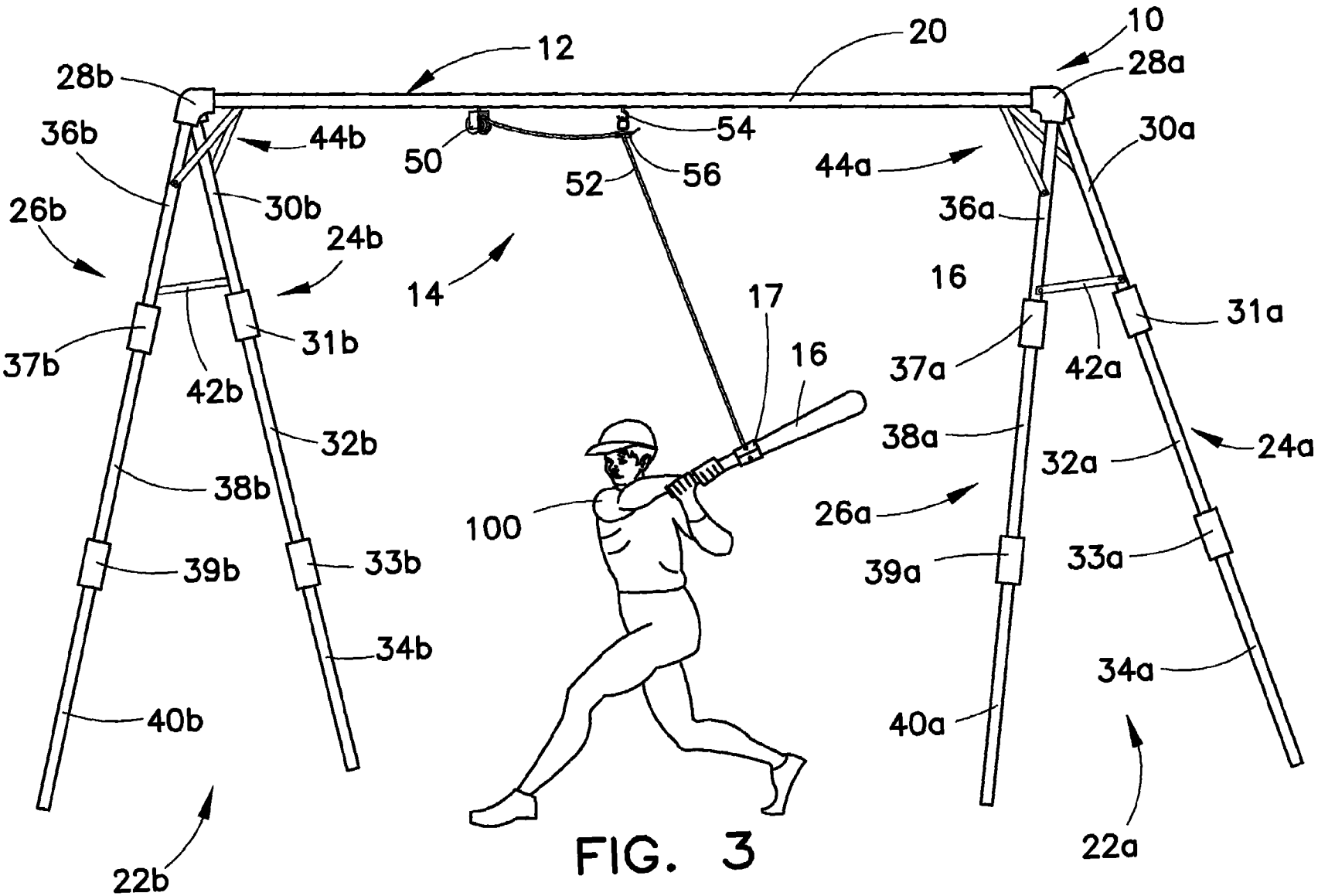
FIG. 3 is a perspective view of the baseball bat swing training device of FIG. 1, the user of which is shown having completed a full swing of the baseball bat.

The set length of cord 53 or working length between the clamping device 54 and the baseball bat 16, however, allows the user or batter 100 to assume a pre-swing position as depicted in FIG. 1 and a follow-through position as depicted in FIG. 3. Thus, there is slack in the cord 52 between the baseball bat 16 and the clamping device 54 when in the pre-swing position of FIG. 1, but taut when in the mid-swing position as depicted in FIG. 2 and the follow-through position as depicted in FIG. 3. The mid-swing position is where the baseball bat 16 should be level. The batter knows when the baseball bat is level when the length of line 53 is taut during the swing.

Figure 5:
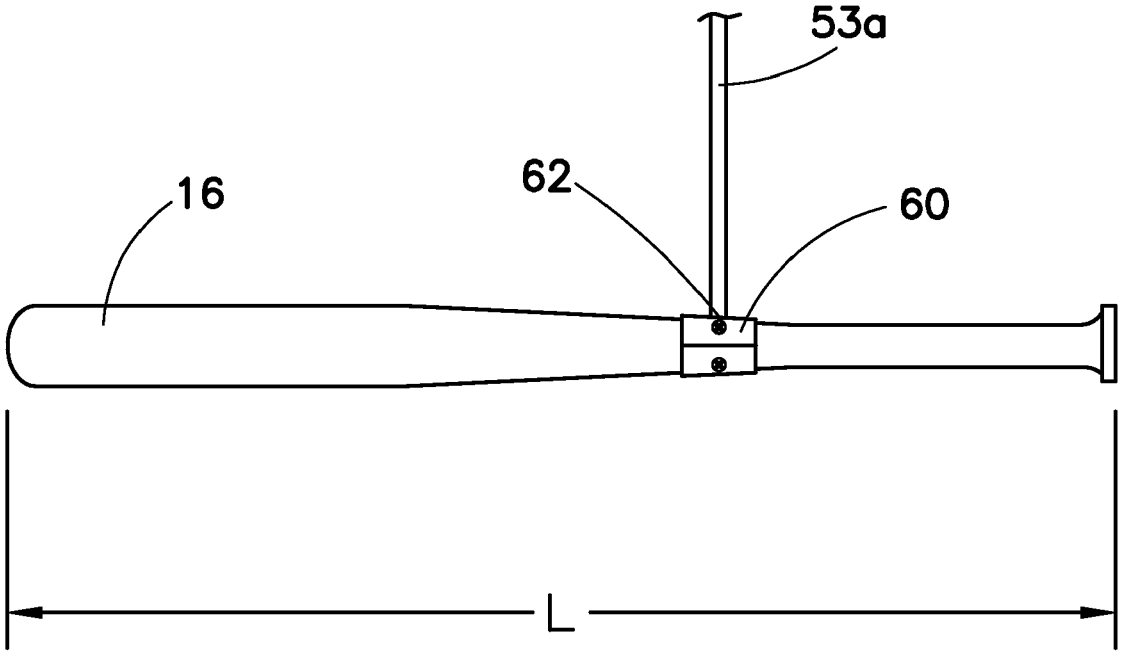
FIG. 5 is an enlarged perspective view of a baseball bat as attached to a line of the present baseball bat swing training device.

In FIG. 5, a close-up view is provided of the baseball bat 16 and its attachment to the baseball bat swing trainer. In this view the working length 53*a* is formed of a flexible but strong plastic, composite or the like such as from a fishing line material or man-made fiber. The working length of line 53*a* is connected to the baseball bat 16 via a baseball bat attachment device 17. The baseball bat attachment device 17 includes or constitutes a collar 60 that wraps around the baseball bat 16 and is mounted thereto via screws or the like. Other mounting means may also be used. The collar 60 includes a ring or otherwise 62 for coupling with the length of line 53*a*. Other types of baseball bat attachment devices may be used. The collar 60 is preferably attached to the baseball bat 16 at a location that is less than half (50%) of the length (L) of the baseball bat 16 as determined from the end of the baseball bat that is held by the user 100. Particularly, the collar 60 is attached to the baseball bat 16 at a location that is 40% of the length of the baseball bat 16 as determined from the end of the baseball bat that is held by the user 100.

The baseball bat swing trainer 10 as shown in FIGS. 1-3 is set up as follows. The height of the cross bar 20 is set relative to the user/batter 100 by adjusting the right and left adjustable leg structures 22*a*, 22*b*. This is accomplished by setting the length of the respective pairs of adjustable legs 24*a*, 26*a* and 24*b*, 26*b*. The height of the cross bar 20 should be well enough above the batter 100 to allow an unobstructed swing and allow slack in the length of line 53 when appropriate. The length of the cross bar 20 is such that the user 100 can easily stand between the right and left adjustable leg structures 22*a*, 22*b* and freely swing the baseball bat 16 without hitting the right or left adjustable leg structure. The working length of the line is then set.

In another embodiment of the invention, the baseball bat swing training device or trainer does not include a frame and thus what was the baseball bat suspension and control device 14 becomes the baseball bat swing training device or swing trainer (see FIG. 4). In this form (and in the others), the baseball bat swing training device includes a line controller 57, a line 52 and a baseball bat attachment device 17. The line controller 57 includes a line reel 50 and a line retention device 56. The line retention device 56 is adapted to be attached to an overhead structure and is configured to clamp onto the line 52 in order to adjustably fix a length of line 53 (working length) extending from the line retention device 56 to the baseball bat attachment device 17 and thus the baseball bat 16. The line reel 50 is adapted to be attached to the overhead structure and is configured to keep and release excess line 55 from and to the line retention device 56. The baseball attachment device 17 is attached to an end of the length of line 53 and is configured to be secured on the baseball bat 16. In this manner, the baseball bat swing trainer may be mounted to a ceiling, an existing frame such as a swing set, a cross beam or otherwise.

Figure 6:
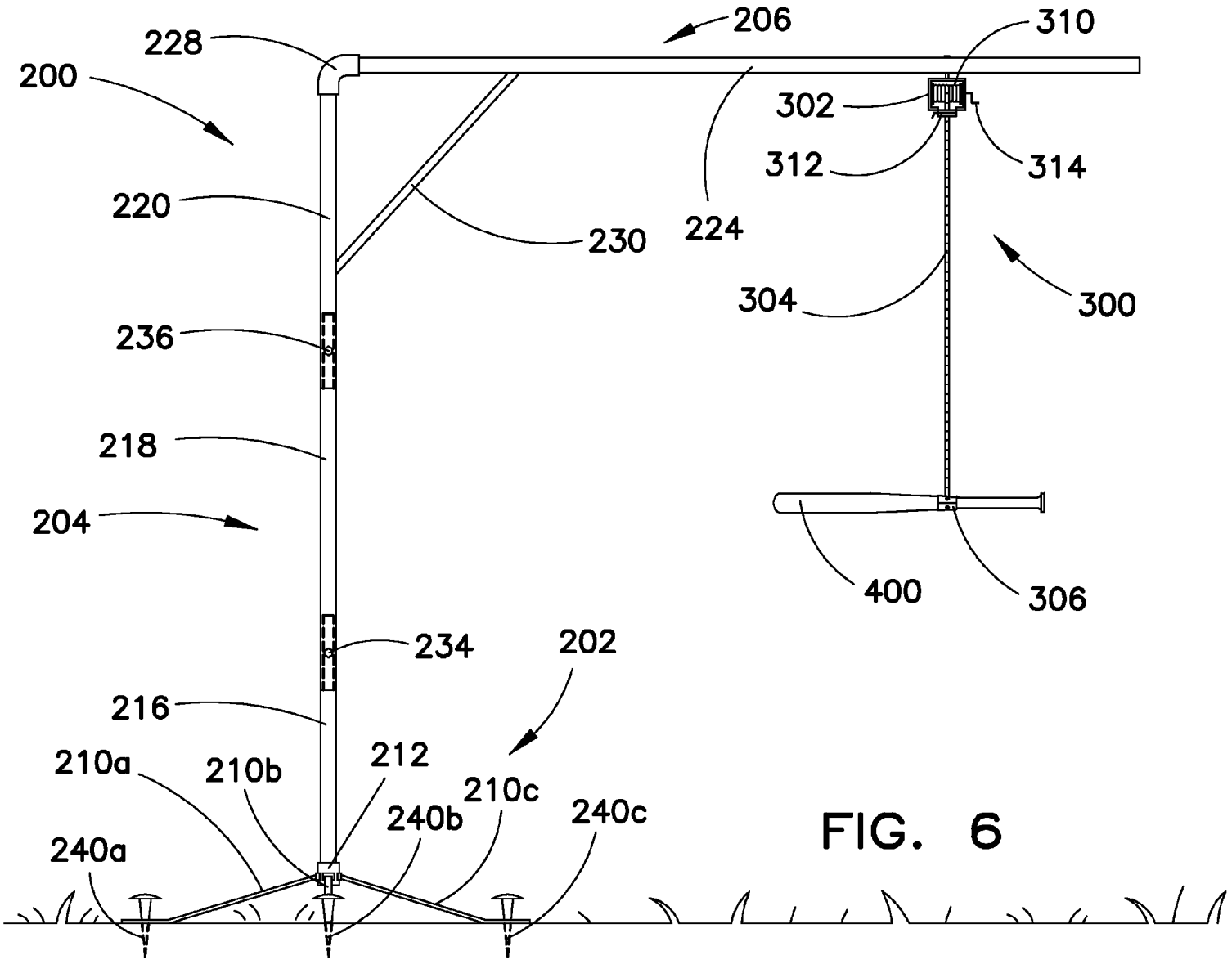
FIG. 6 is a side view of another baseball bat swing training device fashioned in accordance with the principles of the present invention.

Referring to FIG. 6, there is depicted a yet another embodiment of a baseball bat swing training device generally designated 300. The baseball bat swing training device 300 may or may not include the frame 200 which may be substituted for frame 12 and vice versa.

The frame 200 includes a base 202 that supports an upright, stand, pole or the like 204 that is connected to and supports an overhead beam 206. The upright 204 is preferably adjustable in height and thus is shown having thee (3) telescoping sections, a lower section 216, a middle section 218 and an upper section 220. The lower section 216 is telescopingly received into the middle section 218 and includes a height adjustment mechanism 234 such as a biased button and a plurality of openings arrangement. The middle section 218 is telescopingly received into the upper section 220 and includes a height adjustment mechanism 236 such as a biased button and a plurality of openings arrangement.

The base 202 is fashioned as a tripod and thus includes three legs 210*a*, 210*b* and 210*c* that extend from the base 202. The legs 210*a*, 210*b* and 210*c* each are preferably attached to the ground by stakes 240*a*, 240*b* and 240*c*. The legs 210*a*, 210*b*, 210*c* are space about the base 202 in a typical tripod relationship. The base 202 may alternatively be a stake that is driven into the ground. Other manners of supporting the upright 204 may be used.

The overhead beam 206 may be formed of one piece as depicted or may be multiple pieces. The beam 206 is connected to the upright via an elbow joint 228 or otherwise. Bracing 230 is provided between the upright 204 and the beam 206.

The baseball bat training device 300 is attached to the beam 206 of the frame 200 and includes a line controller 302, line 304 and a baseball bat attachment 306. The line controller 302 keeps excess line as appropriate and releases excess line as appropriate in order to select and maintain a working or batting length or height of the line 304 between the line controller 302 and the baseball bat 400. The line controller 302 combines the functions of the separate components of the line controller 14. The line controller 302 includes a reel 310 and line clamp 312. A handle or crank 314 is provided for manual operation of the line reel 310. The line controller 302 may also be automatic. An electric motor or the like and motive power (e.g. battery or solar panel) may be provided to provide automatic adjustment of the working height. In this case, the line controller 302 would have appropriate controls.

While the invention has been illustrated and described in detail in the drawings and foregoing description, the same is to be considered as illustrative and not restrictive in character, it being understood that only preferred embodiments have been shown and described and that all changes and modifications that come within the spirit of the invention are desired to be protected.

What is claimed is:

1. A baseball bat swing training device for training a batter to swing a baseball bat level, the baseball bat swing training device comprising:

a baseball bat coupling for attachment to a baseball bat;

a line having a first end, a second end and a total length, the second end of the line attached to the baseball bat coupling; and a single-unit line controller configured for attachment to a horizontal structure that is vertically over the head of the batter and to vertically hang from the horizontal structure so as to be over the head of the batter, the single-unit line controller retaining both the first end of the line and an excess length of line of the total length of line, the single-unit line controller adapted to vary and to fix a working length of line of the excess length of line, the working length defined as from the single-unit line controller to the baseball bat coupling;

wherein the single-unit line controller varies and fixes the working length of line by receiving, storing and releasing the excess length of line from itself; and wherein the single-unit line controller comprises:

a line reel;

a clamp; and whereby the fixed working length of line limits swinging of the baseball bat connected by the baseball bat coupling to the fixed working length of line by the batter to not below a level baseball bat swing.

2. The baseball bat swing training device of claim 1, wherein the reel comprises:

a spool; and a bracket rotatably carrying the spool.

3. The baseball bat swing training device of claim 1, wherein the baseball bat coupling comprises a collar.

4. The baseball bat swing training device of claim 1, wherein the baseball bat coupling is configured to attach to the baseball bat at a location taken from a handle of the baseball bat that is approximately 50% of an overall length of the baseball bat.

5. A baseball bat swing training device for training a batter to swing a baseball bat level, the baseball bat swing training device comprising:

a frame having horizontal member that is situated to be over the head of the batter during use;

a coupling for attachment to a baseball bat;

a line having a first end, a second end and a total length, the second end of the line attached to the coupling; and a single-unit line controller vertically hanging from the horizontal member over the head of the batter, the single-unit line controller retaining both the first end of the line and an excess length of line of the total length of line, the single-unit line controller adapted to vary and to fix a working length of line of the excess length of line, the working length defined as from the single-unit line controller to the baseball bat coupling; and wherein the single-unit line controller comprises a combined reel and clamp; and whereby the fixed working length of line limits swinging of the baseball bat connected by the baseball bat coupling to the fixed working length of line by the batter to not below a level baseball bat swing.

6. The baseball bat swing training device of claim 5, wherein the frame further comprises a vertical leg structure, the horizontal member being supported by and extending from an upper end of the vertical leg structure to situate the horizontal member over the head of the batter during use.

7. The baseball bat swing training device of claim 6, wherein the vertical leg structure is vertically adjustable.

8. The baseball bat swing training device of claim 7, further comprising a base situated at a lower end of the vertically adjustable leg structure.

9. The baseball bat swing training device of claim 8, wherein the base comprises a tripod.

10. The baseball bat swing training device of claim 5, wherein the reel comprises:

a spool; and a bracket rotatably carrying the spool.

11. The baseball bat swing training device of claim 5, wherein the coupling comprises a collar.

12. The baseball bat swing training device of claim 5, wherein coupling is configured to attach to the baseball bat at a location taken from a handle of the baseball bat that is approximately 50% of an overall length of the baseball bat.

* * * * *